US005431114A

United States Patent [19]

Morita et al.

[11] Patent Number: 5,431,114

[45] Date of Patent: Jul. 11, 1995

[54] COMBUSTION APPARATUS

[75] Inventors: Shigeki Morita, Hiroshima; Kouji Kuramashi; Shigeto Nakashita, both of Kure; Keiji Ishii, Kamagaya; Tadashi Jimbo, Kure; Kunio Hodozuka, Kure; Akira Baba, Kure; Hironobu Kobayashi, Katsuta, all of Japan

[73] Assignee: Babcock-Hitachi Kabushiki Kaisha, Tokyo, Japan

[21] Appl. No.: 121,423

[22] Filed: Sep. 16, 1993

Related U.S. Application Data

[62] Division of Ser. No. 835,456, Mar. 2, 1992, Pat. No. 5,263,426.

[30] Foreign Application Priority Data

Jun. 29, 1990 [JP] Japan ..... 2-169971
Jul. 23, 1990 [JP] Japan ..... 2-192916
Jun. 27, 1991 [WO] WIPO ..... PCT/JP91/00868

[51] Int. Cl.[6] ..... F23D 1/00
[52] U.S. Cl. ..... 110/265; 110/264
[58] Field of Search ..... 110/261, 263, 264, 265, 110/347; 431/284, 285

[56] References Cited

U.S. PATENT DOCUMENTS 4,545,307 10/1985 Morita et al. ..... 110/264
4,807,541 2/1989 Masai et al. ..... 110/264 X
5,090,339 2/1992 Okiura et al. ..... 110/263

*Primary Examiner*—Henry A. Bennet
*Assistant Examiner*—Siddharth Ohri
*Attorney, Agent, or Firm*—Antonelli, Terry, Stout & Kraus

[57] ABSTRACT

A combustion apparatus including a mixture feeding pipe for injecting a mixture of pulverized coal for combustion air into a furnace, with the mixture being then ignited. A first gas feeding passage is disposed outwardly of the mixture feeding pipe for feeding oxygen-containing gas into the furnace, with a second gas feeding passage being disposed between the gas feeding passage and the mixture feeding pipe, in a radial direction, for feeding the oxygen-containing gas into the furnace. A projection is disposed between the gas feeding passage and the mixture feeding pipe and extends at an exposed end surface thereof into the furnace beyond an exposed end of the mixture feeding pipe, with the projection being hollow for allowing the oxygen-containing gas to flow within the projection.

7 Claims, 11 Drawing Sheets

COMBUSTION APPARATUS

CROSS REFERENCE TO RELATED APPLICATIONS

This application is a Divisional Application of U.S. application Ser. No. 07/835,456 filed Mar. 2, 1992, now U.S. Pat. No. 5,263,426.

FIELD OF THE INVENTION

The present invention relates to a combustion apparatus and, for example, to a combustion apparatus of a pulverized coal boiler.

BACKGROUND OF THE INVENTION

In a pulverized coal firing boiler, a combustion apparatus injects a mixture of pulverized coal and air into a furnace through a mixture feeding pipe. The mixture injected is ignited so as to form a flame in the furnace. As disclosed in United States Patent and Trademark Office U.S. Pat. No. 4,545,307, a radially outwardly flared flame maintaining ring is provided at an end of the mixture feeding pipe. Vortices of the mixture are formed along the flame maintaining ring so that the pulverized coal is concentrated in a vicinity of the flame maintaining ring. As a result an ignition takes place from the end portion of the mixture feeding pipe located in the furnace to form a high temperature strong reduction flame, thereby making it possible to suppress the generation of nitrogen oxides (NOx).

Disadvantages of the above construction reside in the fact that the flame maintaining ring gets covered with ashes and is maintained under a reduced atmosphere and, further, is exposed to high temperatures due to radiant heat from the furnace. These conditions may cause a burn out of the flame maintaining ring or, when the operation is not proper, a formation of slag on the flame maintaining ring, that is, promotion of the slagging, under certain circumstances. The burn out of the flame maintaining ring or the formation of slag results in the deterioration of the effect of the flame maintaining ring, an increase of the amount of NOx or malfunctioning of the apparatus.

SUMMARY OF THE INVENTION

Accordingly, an object of the present invention is to provide a combustion apparatus capable of effecting a low NOx combustion in a stabilized manner regardless of the unit capacity of the operating load of the combustion apparatus.

To this end, according to the present invention, a radiation from the flame is shut off and one of three factors of occurrence of slagging, namely, high temperature, reduced atmosphere and existence of ash, is limited. According to the present invention, a projection extends into a furnace beyond a flame maintaining means so as to adequately prevent radiation from the inside of the furnace to the flame maintaining means and to suppress and excessive increase in temperature, thereby restraining the burn out of the flame maintaining means and the occurrence of the slagging on the flame maintaining means.

Since the projection extends at an exposed end surface thereof into the furnace beyond an exposed end of the mixture feeding part, the oxygen-containing gas is supplied from a position radially outwardly of the projection means is isolated from the mixture feeding pipe by a predetermined distance sufficient so as to result in the flame formed immediately after the exposed end of the mixture feeding pipe a strong reducing flame, thereby providing a low NOx combustion.

Within the projection means, the oxygen-containing gas flows so as to cool the same. Consequently, it is possible to prevent a burning of the projection means and the build-up of slag on the exposed end surface of the projection, even though the projection extends into the furnace.

Moreover, in accordance with the present invention, the projection may include a flat exposed end surface, with the flame being held in a downstream position of the flat exposed end surface of the projection. Thus, an inner flame is formed after the mixture feeding pipe as well as an outer flange which is formed so as to surround the inner flame. As a result, the inner flame is held in a condition of stronger reduction and at a higher temperature thereby being more effective in providing a low NOx.

DETAILED DESCRIPTION

Figure 1:
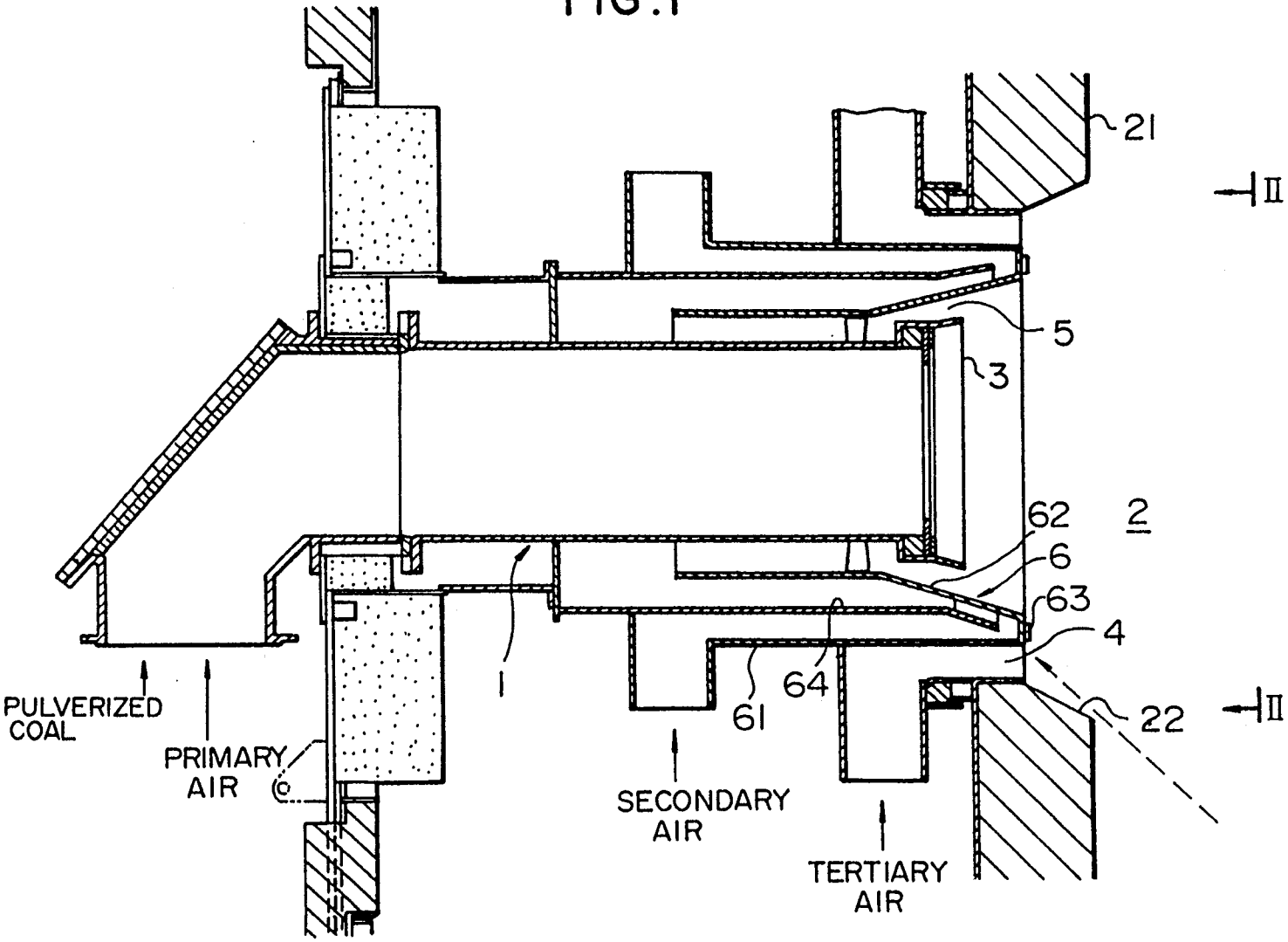
FIG. 1 is a sectional view of a combustion apparatus according to an embodiment of the present invention.

Referring now to the drawings wherein like reference numerals are used throughout the various views to designate like parts and, more particularly, to FIG. 1, according to this figure, a combustion apparatus is provided which includes a bent mixture feeding pipe 1, with the combustion apparatus serving to burn pulverized coal as powdery fuel in air as an oxygen-containing gas. The mixture feeding pipe, at one end thereof, faces into a furnace 2 through an opening 22 formed in a furnace wall 21 of the furnace 2 and communicates, at the other end thereof with a coal mill (not shown). A mixture of the pulverized coal and the primary air flows through the mixture feeding pipe 1. The mixture is ignited to form a flame in the furnace 2.

Figure 2:
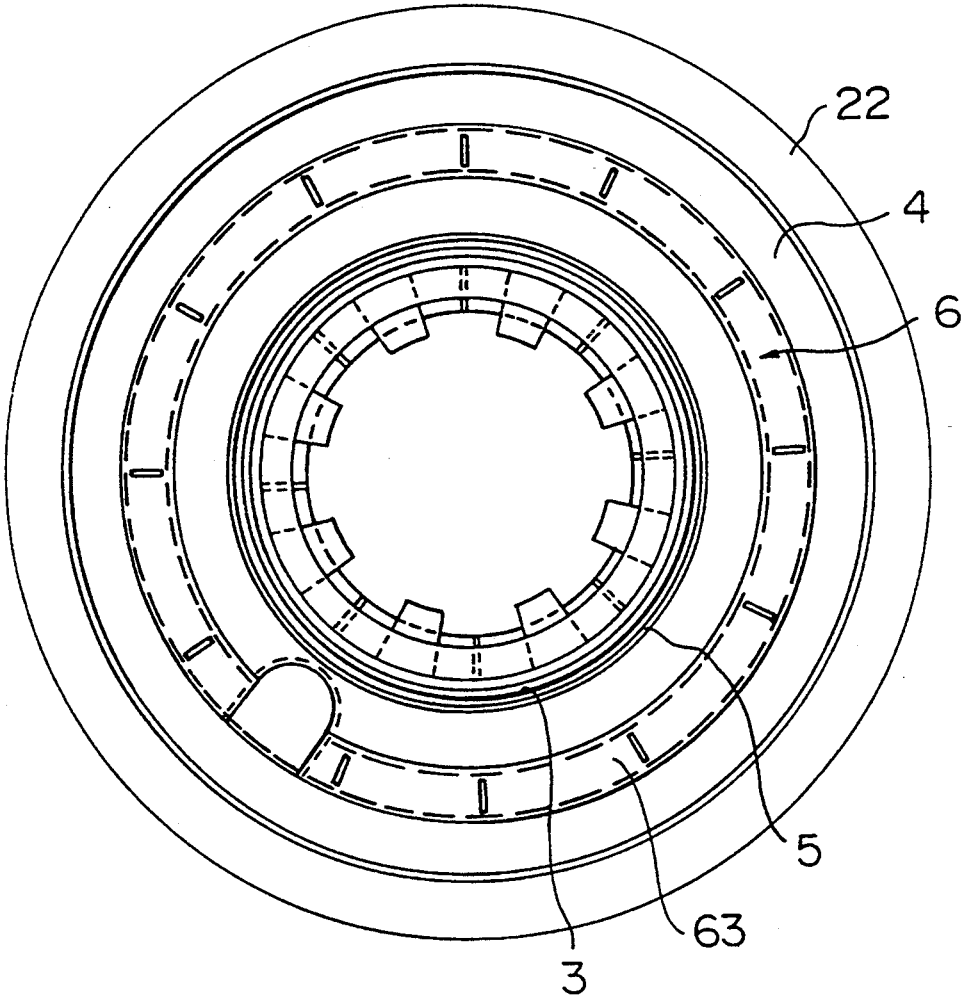
FIG. 2 is a frontal view taken along the lines II—II in FIG. 1;p

A flame maintaining ring 3 having an L-shaped cross section is provided at the peripheral end portion of the mixture feeding pipe 1. As shown in FIG. 2, an annular flow passage 4 is disposed so as to be radially outwardly positioned of the mixture feeding pipe 1 to be concentric therewith. Tertiary air is fed into the furnace 2 through the flow passage 4.

An annular projection 6 is disposed between the mixture feeding pipe 1 and the flow passage 4. The projection 6 extends into the first two beyond the flame maintaining ring 3. An outer peripheral wall 61 of the projection 6 extends in parallel with the mixture feeding pipe 1 and an inner peripheral wall 62 thereof expands radially outwardly at its end portion. Both peripheral walls 61 and 62 terminate in an end disk 63.

Figure 3:
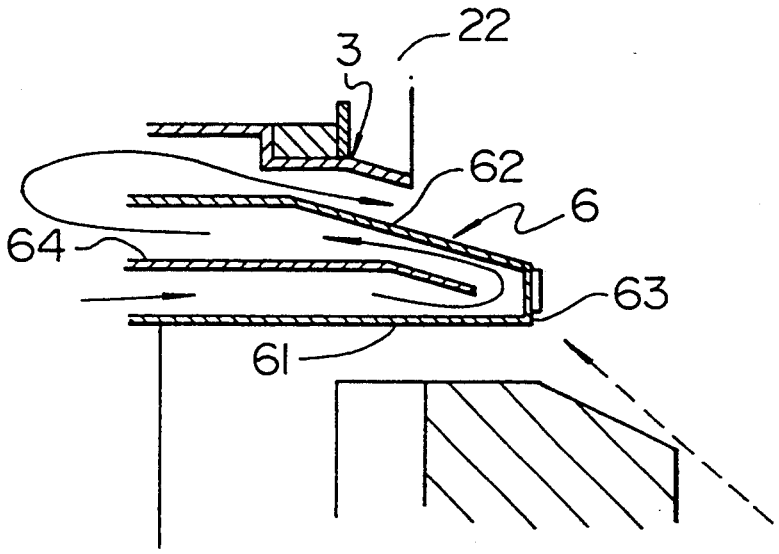
FIG. 3 is a partial fragmentary sectional view illustrating a projection shown in FIG. 1.

Referring to FIGS. 1 and 3, an interior of the projection 6 divided into two layers by a partition tube 64. Secondary air flows in a serpentine manner through a passage portion defined by the outer peripheral wall 61 of the projection 6 and the partition tube 64, a passage portion defined by the inner peripheral wall 62 of the projection 6 and the partition tube 64 in a passage portion defined by the inner peripheral wall 61 of the projection 6 and the mixture feeding pipe 1, as indicated by arrows, and then flows into the furnace 2. Since the inner peripheral wall 62 of the projection 6 expands in a radially outward direction at the end portion thereof, a speed of the secondary air is reduced so that a part of the secondary air can be consumed for maintaining the flame without disturbing the jet of the mixture. This makes it possible to form a high temperature reduction flame in a stabilized manner. Consequently, it is possible to suppress the production of NOx.

The flame maintaining ring 3 is at a reduced atmosphere, and the pulverized coal is concentrated in a vicinity of the flame maintaining ring due to vortices. Further, the flame maintaining ring 3 is usually exposed to high temperatures attributable to the radiant heat from the furnace 2 as indicated by the broken lines in FIGS. 1 and 3. However, since the projection 6 extends beyond the flame maintaining ring 3 into the furnace 2 to moderately prevent radiation toward the flame maintaining ring, the flame maintaining ring 3 is not exposed to an excessively high temperature. Consequently, even when the unit capacity of the combustion apparatus is increased, for example, to above 50 MW thermal, the maintaining ring 3 is protected from being burnt out or exposed to the production of slag.

On the other hand, the projection 6 is now brought into a state where it gets covered with ashes and is disposed in the reduced atmosphere and, further, exposed to high temperatures due to the radiant heat from the furnace 2. For this reason, there is a possibility that the projection 6 may be subjected to slagging. To cope with this, in the present invention, the projection 6 is not disposed in the reduced atmosphere but in an oxidized atmosphere. By so doing, one of the factors of occurrence of slagging can be eliminated, thereby making it possible to prevent the occurrence of the slagging.

Figure 4:
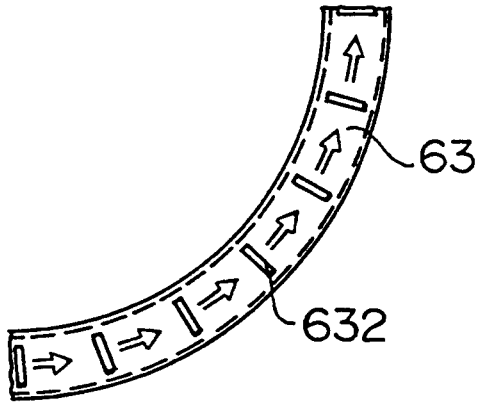
FIG. 4 is a partial fragmentary front view of the projection of FIG. 3.
Figure 5:
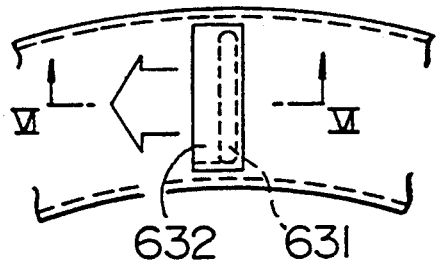
FIG. 5 is an enlarged fragmentary frontal view of the projection of FIG. 4.
Figure 6:
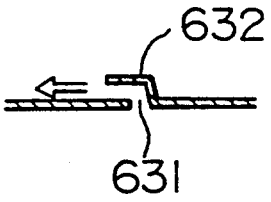
FIG. 6 is a sectional view taken along the lines VI—VI in FIG. 5.

To form the oxidized atmosphere, an end disk 63 is provided with a plurality of radial slits 631 which are equiangularly spaced, as shown in FIGS. 4–6. A part of the secondary air is jetted out of these slits 631 and is guided by guide plates 632 so that the secondary air flows circumferentially on the surface of the projection 6. Consequently, the projection 6 can be maintained under the oxidized atmosphere, resulting in the prevention of the production of slag.

It is noted in this embodiment that the secondary air cools the projection 6 while the secondary air flows through the passage portion defined by the outer peripheral wall 61 of the projection 6 and the partition tube 64, the passage portion defined by the inner peripheral wall 62 of the projection 6 and the mixture feeding pipe 1. The flow of the secondary air of about 300° C. results in the temperature of the projection being about 950° C. or below, at which temperature hardly any slag is produced. Consequently, it is possible to minimize the formation of slag at the projection 6 as well as to increase the service life of the projection 6. On the other hand, since the temperature of the secondary air is increased about 40° C. due to the radiant heat from the furnace 2, the combustion efficiency can be improved.

Figure 7:
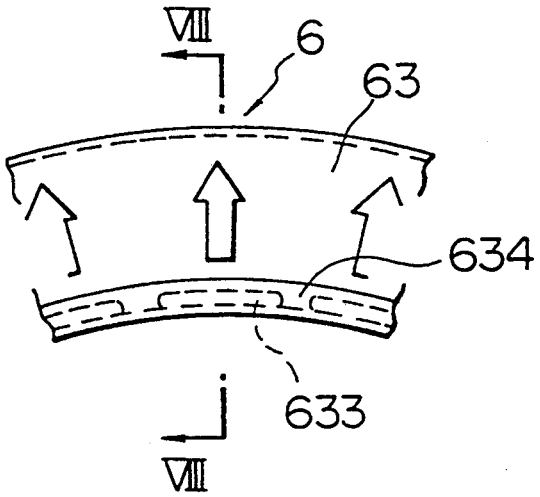
FIG. 7, is a partial fragmentary front view illustrating a modification of the projection.
Figure 8:
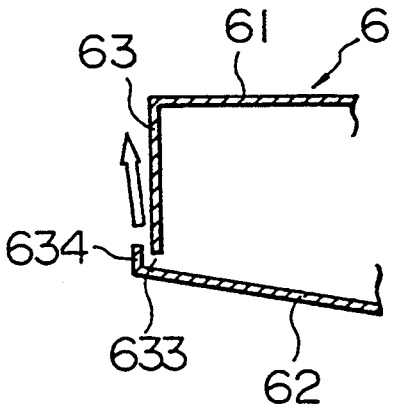
FIG. 8 is a fragmentary sectional view taken along the lines VIII—VIII in FIG. 7.
Figure 9:
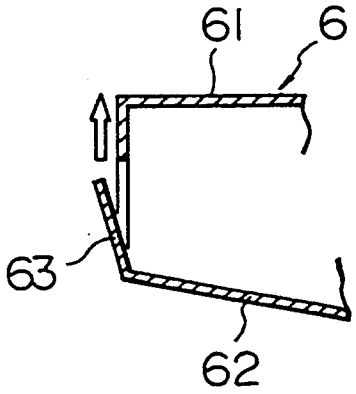
FIG. 9 is a fragmentary sectional view illustrating another modification of the projection.

In a modification shown in FIGS. 7 and 8, a plurality of circumferential slits 633 are equiangularly disposed in the end disk 63, so that a part of the secondary air is guided by the guide plates 634 to flow radially outwardly of the surface of the projection 6. As a result, a production of slag can be prevented as in the above-described embodiment. In another modification, shown in FIG. 9, the end disk is partially cut off and inclined.

Figure 10:
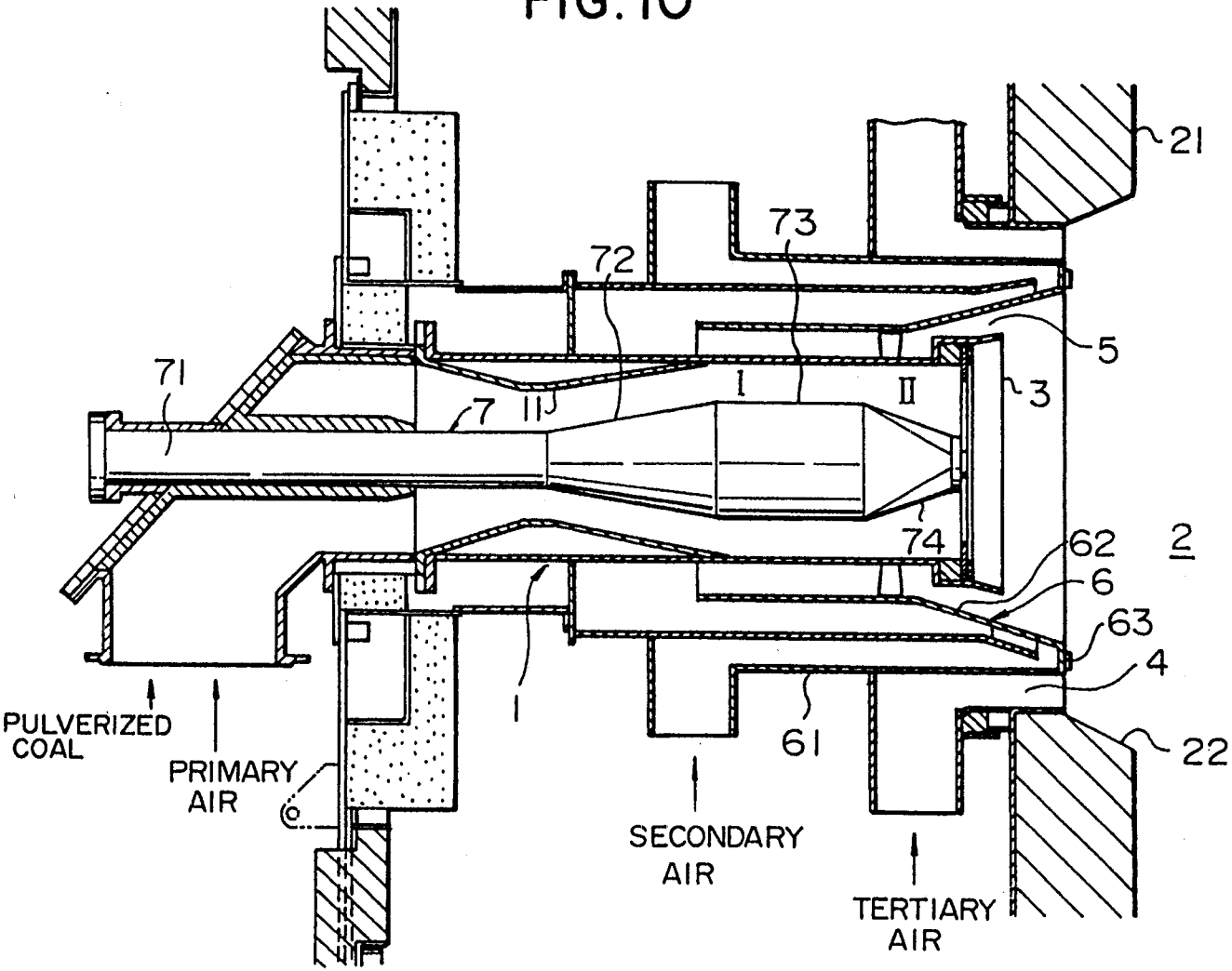
FIG. 10 is a sectional view of another embodiment of the combustion apparatus of the present invention.
Figure 11:
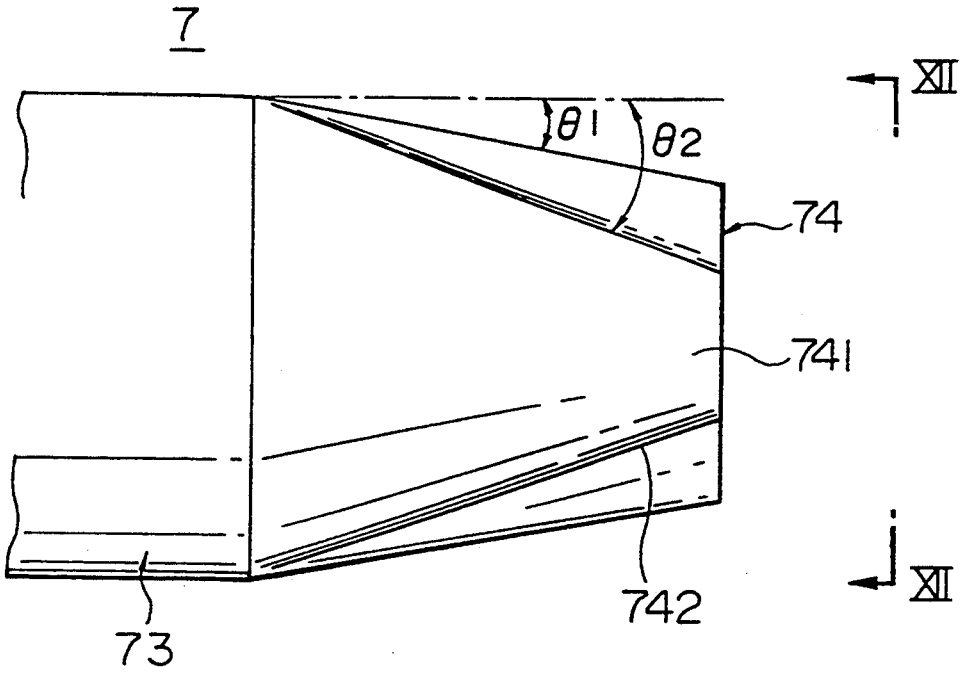
FIG. 11 is a side view of a conical portion of a pulverized coal/air separating member shown in FIG. 10.

In the embodiment of FIG. 10, in order to increase the concentration of the mixture around the mixture feeding pipe 1, a pulverized coal/air separating rod member 7 is coaxially disposed inside of the mixture feeding pipe 1. The separating member 7 is attached to the mixture feeding pipe at a stem portion 71. The separating member 7 includes a flared portion 72 defining a throat portion in cooperation with a projecting member 11 provided in the mixture feeding pipe 1. A speed of the mixture is reduced at the throat portion. Further, the separating member 7 comprises a right circular cylindrical portion 73 and a conical portion 74 which extends from the right circular cylindrical portion so as to be tapered toward a downstream side of the flow of the mixture. The right circular cylindrical portion 73 cooperates with the mixture feeding pipe 1 to define therebetween a mixture passage portion I having a constant area t. The conical portion 74 cooperates with the mixture feeding pipe 1 to define therebetween a mixture passage portion II having a gradually increasing area in a direction of the flow of the mixture.

The speed of the mixture is increased in the passage portion I and, when the mixture flows through the passage portion II, the pulverized coal is separated from the mixture due to its inertia and then flows in a radially outward direction. As a result, the pulverized coal is concentrated in the vicinity of the flame maintaining ring 3. Therefore, even if the load of the combustion apparatus is reduced to, for example, to about 30% of the load of the mill, it is possible to effect a highly efficient combustion with a low amount of NOx being produced. However, if the conical portion 74 is uniformly tapered, there is a possibility that the mixture may separate from the conical portion. Once the separation occurs, the pulverized coal, once concentrated in the vicinity of the flame maintaining ring 3, is radially inwardly displaced due to the separated flow, resulting in the possibility that the concentration of the pulverized coal in the vicinity of the flame maintaining ring 3 is reduced. Further, it is impossible to specify the location where such separation is caused.

For this reason, according to the present invention, the separation of the flow occurs exactly or forcibly at the predetermined portions on the conical portion. Additionally, the portions at which the separation occurs are circumferentially located. In other words, the portions where the separation is prevented from occurring are circumferentially equiangularly located as well. Consequently, the concentration of the pulverized coal in the vicinity of the flame maintaining ring 3 becomes circumferentially uniform and, therefore, it is possible to effect a stabilized combustion.

To this end, in the present embodiment, the conical portion 74 includes portions 741 each subtending a tapering angle $\theta_1$ with respect to the axial direction and portions 742 each subtending a tapering angle $\theta_2$ ($>\theta_1$) with respect to the axial direction, which portions 741 alternate with the portions 742 as shown in FIGS. 11–14.

Figure 12:
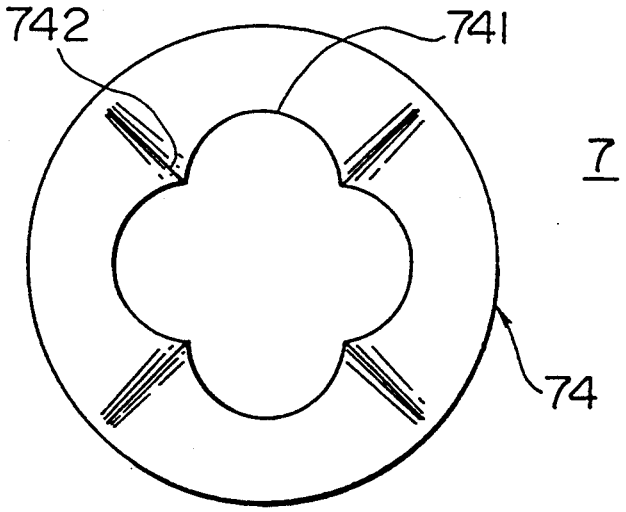
FIG. 12 is a frontal view taken along the lines XII—XII in FIG. 11.
Figure 13:
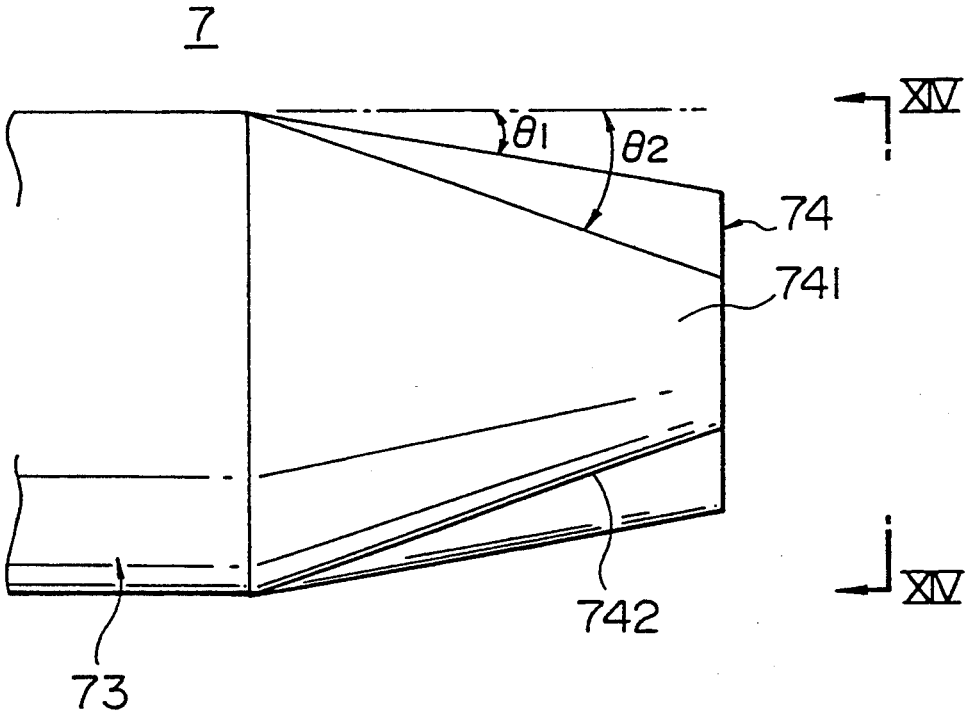
FIG. 13 is a side view illustrating the conical portion of another pulverized coal/air separating member.
Figure 14:
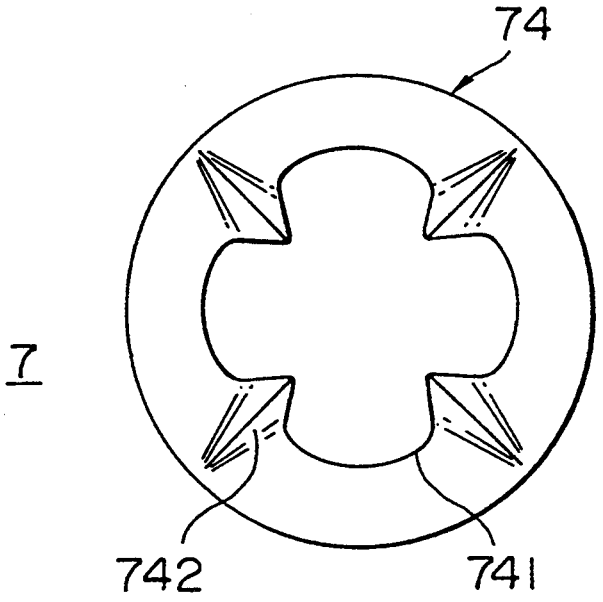
FIG. 14 is a frontal view taken along the lines XIV—XIV in FIG. 13.
Figure 15:
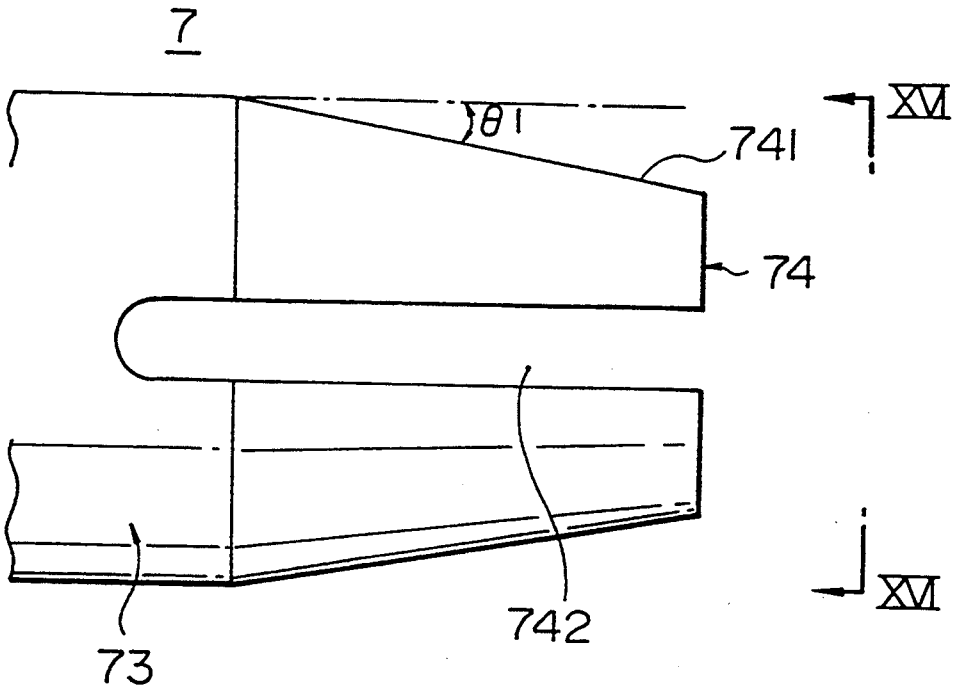
FIG. 15 is a side view illustrating the conical portion of yet another pulverized coal/air separating member.
Figure 16:
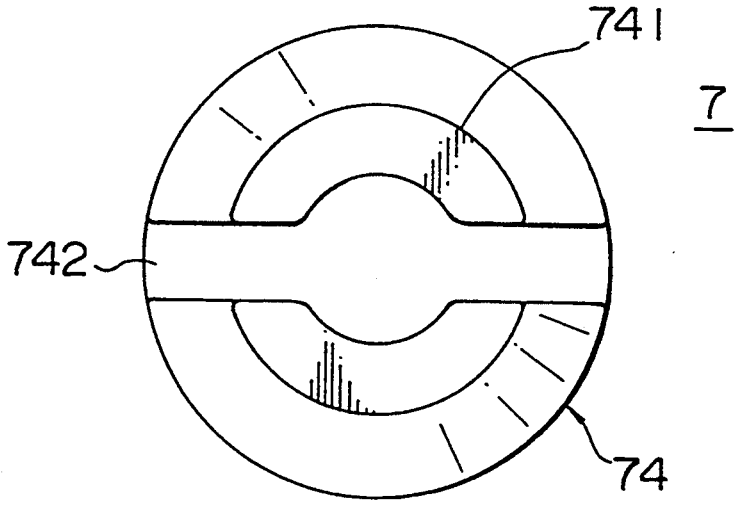
FIG. 16 is a frontal view taken along the lines XVI—XVI in FIG. 15.

The tapering angle $\theta_1$, is in a range of between 5°–15°, and the tapering angle $\theta_2$ is in a range of 25°–65°. The separation occurs in the portions 72 but does not occur in the portions 741. Furthermore, the area occupied by the portions 741 is larger than that occupied by the portions 742. Consequently, the effect of the separation can be minimized, thereby enhancing a stabilized combustion. The portions 741 and 742 may be connected smoothly as shown in FIG. 12 or steeply as shown in FIG. 14. The tapering angle $\theta_2$ of the portion where the separation occurs is not limited to the range of 25°–65°. Even when the tapering angle $\theta_2$ is 90° that is, even when the portion 742 is a slit as shown in FIGS. 15 and 16, the same effects can be obtained.

Figure 17:
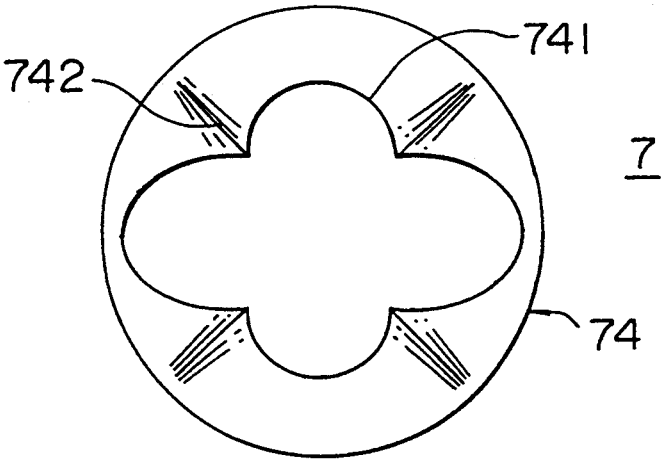
FIGS. 17–19 are sectional views illustrating the modifications of the conical portion of the pulverized coal/air separating member.
Figure 18:
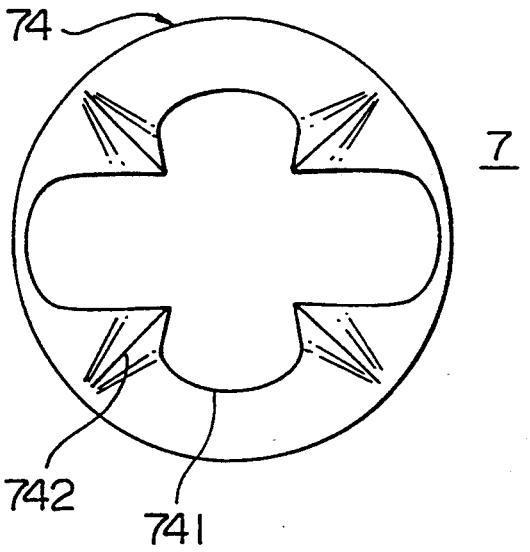
Figure 19:
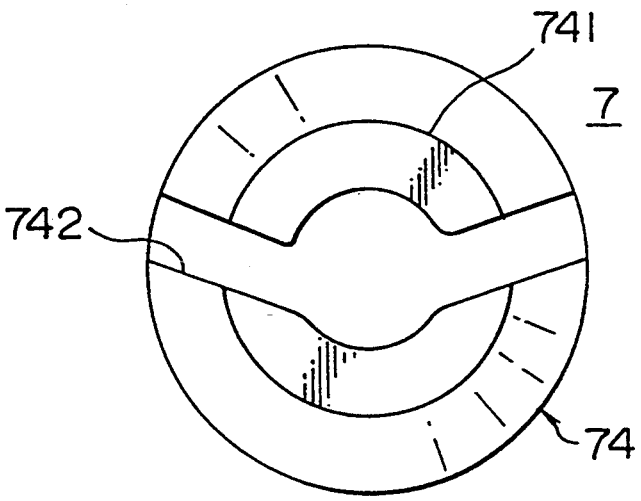

Furthermore, as shown in FIGS. 17–19, the portions 741 and 742 may be arranged asymmetrically.

Additionally, although the projection and the pulverized coal/air separating members are illustrated as being integral in this embodiment, a pulverized coal/air separating member and the projection can be individual elements.

Figure 20:
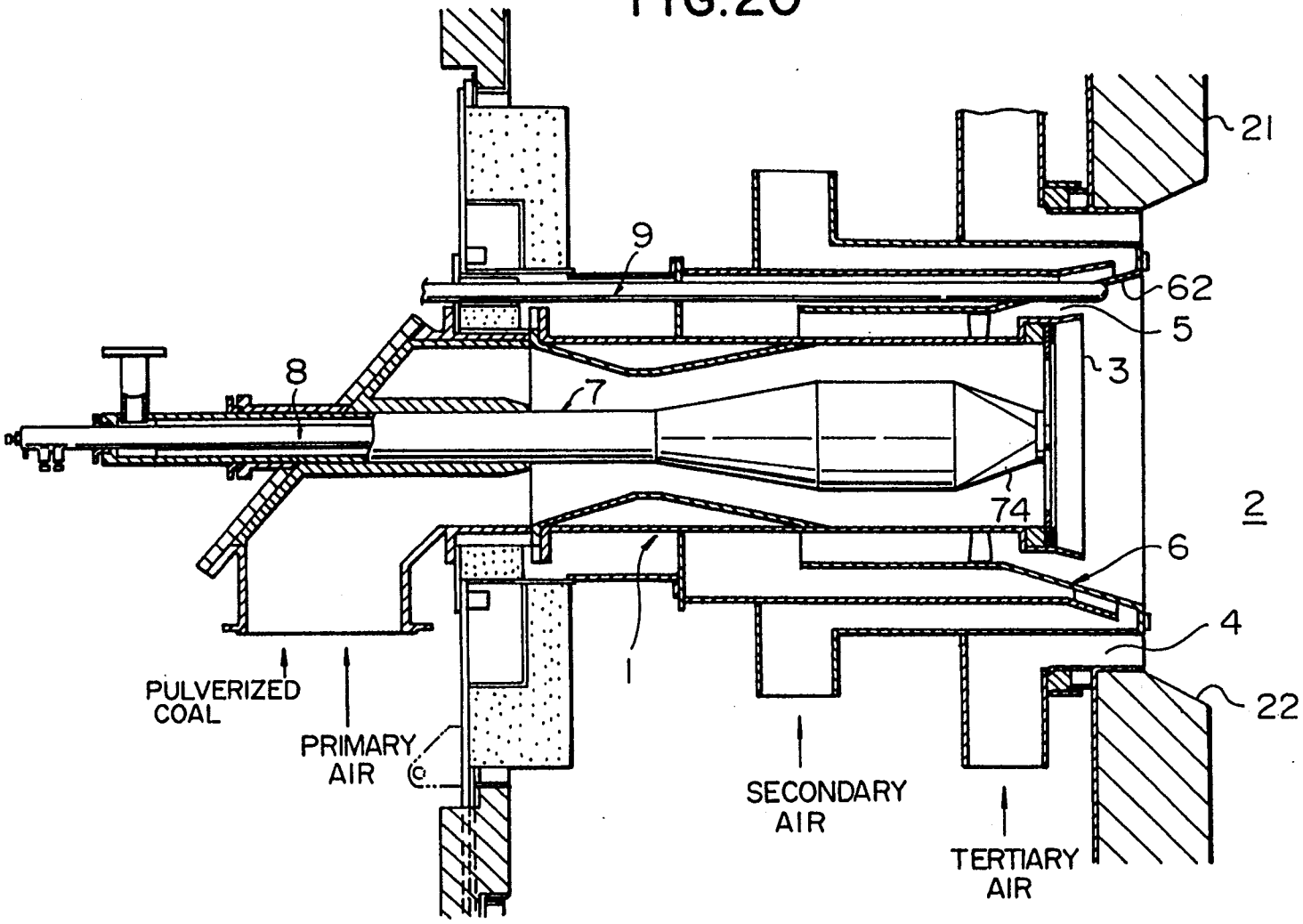
FIG. 20 is a sectional view of a different combustion apparatus.

Moreover, the present invention is also applicable to a pulverized coal combustion apparatus as shown in FIG. 20 which is equipped with a start-up oil burner 8 and an auxiliary gas burner 9. The oil burner extends through the separating member 7 to the tip end of the conical portion 74. The gas burner 9 extends through the inner peripheral wall 62 into the furnace 2 to the extent that it cannot be prevented from being exposed to the radiation from the inside of the furnace 2.

While we have shown and described several embodiments in accordance with the present invention, it is understood that the same is not limited thereto but is susceptible to numerous changes and modifications as known to one of ordinary skill in the art, and we therefore do not wish to be limited to the details shown and described herein, but intend to cover all such modifications as are encompassed by the scope of the appended claims.

We claim:

1. A combustion apparatus comprising:

a mixture feeding pipe exposed in a furnace for feeding a mixture of powdery fuel and oxygen-containing gas into said furnace;

a first gas feeding passage disposed outwardly of said mixture feeding pipe for feeding an oxygen-containing gas into said furnace;

a second gas feeding passage disposed, in a radial direction, between said first gas feeding passage and said mixture feeding pipe for feeding an oxygen-containing gas into said furnace; and projection means disposed between said first or second gas feeding passages and said mixture feeding pipe, in a radial direction, and extending at an exposed end surface thereof into said furnace beyond an exposed end of said mixture feeding pipe, said projection means being hollow for allowing the oxygen-containing gas to flow within said projection means.

2. A combustion apparatus according to claim 1, wherein said exposed end surface of said projection means is flat.

3. A combustion apparatus according to claim 1, further comprising a powdery/oxygen-containing gas separating member disposed inside of said mixture feeding pipe coaxially with said mixture feeding pipe, said separating member including a right circular cylindrical portion which cooperates with said mixture feeding pipe to define therebetween a mixture feeding passage portion having a substantially constant cross sectional area, and a conical portion extending from said right circular cylindrical portion and being tapered toward a downstream side of a flow of the mixture so as to cooperate with said mixture feeding pipe to define therebetween a further mixture feeding passage portion having a sectional area which gradually increases in a direction of the flow of the mixture.

4. A combustion apparatus according to claim 1, wherein said projection means includes an opening through which a part of the oxygen-containing gas flowing within said projection means is ejected toward said exposed end surface of said projection means.

5. A combustion apparatus according to claim 1, wherein said projection means is disposed between the first gas feeding passage and said second gas feeding passage in a radial direction.

6. A combustion apparatus according to claim 1, wherein said projection means forms said second gas feeding passage.

7. A combustion apparatus according to claim 3, wherein said conical portion has a first portion where separation of the flow occurs and a second portion where separation of the flow does not occur, and wherein said first and second portions of the conical portions alternate circumferentially.

* * * * *